US007045192B2

(12) United States Patent
John et al.

(10) Patent No.: US 7,045,192 B2
(45) Date of Patent: May 16, 2006

(54) WEATHER RESISTANT ANTI-SLIP PANELS

(75) Inventors: Wayne Morgan John, Leeds (GB); Neil Kettlewell, Leeds (GB); Catherine Janet Ripley, Leeds (GB)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/813,936

(22) Filed: Mar. 22, 2001

(65) Prior Publication Data

US 2001/0036532 A1 Nov. 1, 2001

(30) Foreign Application Priority Data

Mar. 22, 2000 (GB) ..... 0006962
Nov. 7, 2000 (GB) ..... 0027205

(51) Int. Cl.
*B32B 3/14* (2006.01)

(52) U.S. Cl. ..... 428/141; 428/43; 428/143; 428/144; 428/195.1; 428/206

(58) Field of Classification Search ..... 428/43, 428/141, 143, 144, 151, 150, 195.1, 206; 15/238; 234/14; 52/177, 179, 181
See application file for complete search history.

(56) References Cited

U.S. PATENT DOCUMENTS

| | | | | | |
|---|---|---|---|---|---|
| 1,625,187 | A | | 4/1927 | NBrich | |
| 2,113,462 | A | | 4/1938 | De Wees | 52/179 |
| 2,337,156 | A | | 12/1943 | Elmendorf | |
| 3,227,604 | A | | 1/1966 | Morgan | |
| 3,901,993 | A | * | 8/1975 | Phillips, Jr. | 428/148 |
| 3,921,350 | A | * | 11/1975 | Van Schoyck | 52/180 |
| 4,154,637 | A | | 5/1979 | Kasten | |
| 4,276,800 | A | | 7/1981 | Koppa et al. | |
| 4,328,274 | A | | 5/1982 | Tarbutton et al. | |
| 4,336,293 | A | * | 6/1982 | Eiden | 428/143 |
| 4,340,633 | A | * | 7/1982 | Robbins, Jr. | 428/99 |
| 4,596,731 | A | | 6/1986 | Cudmore et al. | |
| 4,693,923 | A | | 9/1987 | McGroarty et al. | |
| 4,931,330 | A | * | 6/1990 | Stier et al. | 428/41.5 |
| 4,959,250 | A | * | 9/1990 | McKinnon | 428/143 |
| 5,053,274 | A | | 10/1991 | Jonas | |
| 5,077,117 | A | * | 12/1991 | Harper et al. | 428/143 |
| 5,380,549 | A | * | 1/1995 | Harvison | 428/143 |
| 5,494,729 | A | | 2/1996 | Henry et al. | |
| 5,500,267 | A | * | 3/1996 | Canning | 428/68 |
| 5,593,246 | A | * | 1/1997 | Hedblom et al. | 428/172 |
| 5,601,900 | A | | 2/1997 | Doscher | 428/149 |
| 5,759,928 | A | | 6/1998 | Harper | 442/337 |
| 5,777,791 | A | | 7/1998 | Hedblom | 359/536 |
| 5,783,303 | A | | 7/1998 | Tsuei | |
| 5,804,241 | A | | 9/1998 | Isohata | |
| 5,815,995 | A | | 10/1998 | Adam | |
| 5,853,846 | A | | 12/1998 | Clark et al. | 428/131 |
| 5,888,604 | A | | 3/1999 | Evans | |
| 6,132,844 | A | | 10/2000 | Altshuler et al. | |
| 6,219,876 | B1 | * | 4/2001 | Blum | 428/195.1 |
| 6,274,232 | B1 | | 8/2001 | Otten et al. | |
| 6,365,262 | B1 | | 4/2002 | Hedblom et al. | 428/143 |
| 6,443,667 | B1 | | 9/2002 | Brown | |
| 6,451,410 | B1 | | 9/2002 | McGuire et al. | |
| 2003/0035927 | A1 | | 2/2003 | Rice et al. | 428/143 |
| 2004/0082271 | A1 | | 4/2004 | Wiswesser et al. | 451/6 |

FOREIGN PATENT DOCUMENTS

| | | |
|---|---|---|
| GB | 2 200 578 | 8/1988 |
| WO | 96/03270 | 2/1996 |

* cited by examiner

*Primary Examiner*—Alicia Chevalier
(74) *Attorney, Agent, or Firm*—Lowe Hauptman & Berner, LLP

(57) ABSTRACT

A shapeable, weather-resistant anti-slip panel has a cut-resistant anti-slip coating on a rigid substrate and a pattern of cuttable lines; this enables the panel to be shaped by cutting the substrate along selected lines and overcomes the problem with known weather resistant anti-slip panels that the anti-slip coating particles, being very hard, make the anti-slip coating very difficult to cut or drill, as the coating readily and speedily blunts cutting tools.

14 Claims, No Drawings

WEATHER RESISTANT ANTI-SLIP PANELS

FIELD OF THE INVENTION

This invention relates to weather resistant anti-slip rigid flooring panels and the like preformed and pre-coated anti-slip products; hereinafter referred to as weather resistant anti-slip panels.

BACKGROUND OF THE INVENTION

Known weather resistant anti-slip panels are, typically formed from rigid wood panels, for example of plywood or the like weather vulnerable material, to the working surface only of which an anti-slip aggregate of sharp, aluminium oxide or silicon carbide particles is bonded with a resin bonding agent. These panels are used outside or inside where an anti-slip surface has to be maintained in adverse, slippery conditions. Weather resistant anti-slip panels may, for example, be used as stair treads, and thus the panels have to be sufficiently rigid for the mechanical requirements of such an given application. The aggregate has to maintain its anti-slip over time in the aforesaid conditions and is thus of very hard, sharp particulate material. All the outer surfaces are coated so as to protect and enhance the weather durability of the wooden substrate. Weather resistant anti-slip panels are now being made with a rigid synthetic or weather resistant substrate, such as glass reinforced plastic, that does not need to be weather proofed and are provided with the anti-slip coating restricted to the working surface or surfaces. The problem with known weather resistant anti-slip panels is that the anti-slip coating particles, being very hard, make the anti-slip coating very difficult to cut or drill, as it readily and speedily blunts a cutting tool. Consequently, weather resistant anti-slip panels are currently either only made to standard sizes or shapes or to specified sizes and shapes and with pre-specified placement of fixing holes, in each case being cut, drilled or otherwise formed prior to application of the anti-slip coating. The standard sized panels obviously limit usage and the special sized panels are, obviously, more expensive to produce. People do attempt to cut or drill weather resistant anti-slip panels on site, using angle grinders, diamond cutters, carbide-tipped twist drills and similar special tools; but generally without success, as even the special tools are damaged and blunted by the anti-slip aggregate and the consequent aesthetics are consequently poor.

Document GB 2200578 A (Armstrong World Industries Inc.) discloses a surface covering product which comprises a substrate material, an impervious coating upon said material, and raised elements selectively printed upon said coating, which raised elements comprise or are derived from a thixotropic plastic containing particles of solid material. Such product creates embossed-in-register features without the need for chemical or mechanical embossing materials. Substrate materials are described as being "Any substrate may be employed in the product and method of the invention, more especially, any of the substrates normally employed in the field. A suitable substrate may be the plastisol-saturated glass mat described in Example 1 below, or a wet-laid felted sheet, also common in the surface covering art" (page 6, lines 3 to 8). The solid particles are described as being "an organic material such, for example as rubber or a plastic material, such as vinyl resin, or an inorganic materials such as, silica quartz." (page 11, lines 15 to 19).

Document W0 96/03270 A (Custom Plastics Molding Inc.) discloses a "thermoformed plastic product such as a track bed liner, having an anti-slip surface is formed. A clean surface of a sheet of, for example HDPE, is masked. Droplets of a sprayable or liquid polymer, such as a thermosetting elastomeric polymer are sprayed or otherwise applied onto the exposed masked off surface area. The droplets form a stippled pattern of primarily separate bumps which upon hardening are hard, but not brittle. After partial hardening of the bumps, the plastic sheet is thermoformed." (Abstract).

Document, U.S. Pat. No. 5,601,900 A (Doscher) discloses an "anti-skid mat for placement upon a slippery surface comprising a resilient matrix sheet member having a top surface and a bottom surface. An abrasive structure on the bottom surface of the resilient matrix sheet member is for preventing slippage of the resilient matrix sheet member on the slippery support surface."(Abstract).

None of these documents disclose the rigid substrates or hard, sharp particles required by the above described weather resistant anti-slip panels and thus do not exhibit the described technical problem of being difficult or impossible to work, that is to cut or drill on-site.

SUMMARY OF THE INVENTION

According to the present invention, a method of shaping a weather resistant anti-slip panel comprises producing a pattern of cuttable lines in a cut-resistant, anti-slip coating on a rigid substrate and subsequently cutting the substrate along selected lines to obtain a desired panel shape.

In a first embodiment of the method of the present invention, the substrate is weather resistant and the cut-resistant, anti-slip coating is solely applied to a working surface of the substrate.

In a second embodiment of the method of the present invention, the substrate is weather vulnerable, is weather vulnerable, the whole of the outside of the substrate is coated and the pattern of aggregate-free lines or the like is solely applied to a working surface of the substrate.

A third embodiment of the method of the present invention comprises producing a pattern of drillable areas in the cut-resistant anti-slip coating and subsequently drilling the substrate at selected areas to obtain a desired placement of fixing holes.

A fourth embodiment of the method of the present invention comprises producing a pattern of cuttable lines which intersect to form the pattern of drillable areas.

Also according to the present invention, a shapeable weather resistant anti-slip panel has a cut-resistant anti-slip coating on a rigid substrate and a pattern of cuttable lines therein; whereby, in use, the substrate may be cut along selected lines to obtain a desired panel shape.

According to a first embodiment of the apparatus of the present invention, the substrate is weather resistant and has the cut-resistant, anti-slip coating solely on a working surface of the substrate.

According to a second embodiment of the apparatus of the present invention, the substrate is weather vulnerable, the whole of the substrate is coated and the pattern of intersecting lines is solely applied to a working surface of the substrate.

According to a third embodiment of the apparatus of the present invention, the panel has a pattern of drillable areas in the cut-resistant coating; whereby, in use, the substrate can be drilled at selected areas to obtain a desired placement of fixing holes.

According to a fourth embodiment of the present invention, the panel has a pattern of intersecting cuttable lines to form the pattern of drillable areas.

A weather resistant anti-slip panel in accordance with the present invention overcomes the above-stated problems because it can simply and readily be cut to shape or have fixing holes drilled on site.

A weather resistant anti-slip panel in accordance with the present invention, has the additional advantage that the cuttable lines also form cutting guide lines.

The pattern of cuttable lines may be of:

a standard rectangular grid, to various dimensions;

a diagonal or rhombic design;

simple perpendicular or parallel lines, for stair tread panels; or, circular or other shaped lines defining coating free areas for fixing holes or cut outs.

DETAILED DESCRIPTION OF THE INVENTION

The above and other features of the present invention are illustrated by the following example.

EXAMPLE

A Weather Resistant Anti-Slip Panel

A sheet of weather resistant, glass reinforced, rigid plastic, for example an unsaturated polyester based on an orthophthalic resin filled with e-glass fibre, 2000–3000 mm long× 1000–2000 mm wide×3–3.5 mm thick; forms a substrate having a Shore D hardness between 80 and 100 (American Standard Test Method ASTM 2240). A fixed, panel test piece 100 mm long×20 mm wide×3.5 mm thick has a maximum panel deflection of 25° when 1 kg is suspended from the free end of the test piece. The panel has a regular grid pattern if 25 mm squares formed on the working surface thereof by laying down lines of 5 mm wide self-adhesive masking tape; the intersections of the grid lines form drilling areas or points for fixing holes. A coating of a base resin, for example an unsaturated polyester based on an orthophthalic resin, was then applied to the working surface with a coverage of approximately 0.1–0.15 kg per sq. meter and aluminium oxide aggregate particle size 0.85–1.7 mm was sprinkled onto the coating with a coverage of 1.8–2.0 Kg per sq. meter; to produce a covering thickness of between 1 and 3 mm, of which up to 2.7 mm will be aggregate. The aggregate is an angular and cubic particulate with a minimum Polished Stone Value of between 50 to 100 and a mohs hardness of between 9 and 10. Excess aggregate was tipped off and the masking tape was removed prior to curing. Once the coating had been permitted to cure, further excess aggregate was brushed off, to leave a pattern of lines of cuttable, coating-free substrate on the or each working surface of the panel. The patterned, coated surface can be over-rolled or over-coated with resin, for example the same unsaturated polyester based on an orthophthalic resin, with a coverage of 0.45–0.50 Kg per sq. meter, to further improve bonding of the aggregate to the substrate, to enhance durability and to look clean and tidy aesthetically. The finished panel has a coefficient of friction (COF) of >0.95 when dry, >0.70 when wet and >0.40 when oily, In use, the panel can be cut on site, using any cutting tool suitable to the substrate material, to a selected shape; defined by cutting along and guided by the appropriate pattern lines. Suitable fixing holes can be drilled by selection of appropriate grid intersections.

Other production methods include screen printing the resin and/or the aggregate or the use of a template.

The present invention can be applied to weather vulnerable substrates, such as plywood and chip board. The whole outer surface of the substrate is coated, to provide weather resistance, and the aggregate pattern is only applied to the working surface. By this means, the coated panel can readily be cut on site but exposed surfaces, edges or holes, have to be sealed to prevent moisture migrating through the substrate to the coating and weakening or destroying the bond between the coating and the substrate.

In addition to providing cutting lines, the pattern can have a decorative effect or form drainage channels in the aggregate.

In an alternative example, a pattern of aggregate could be embedded in the surface of an uncured resin substrate or in alternative thermo-set or thermo-plastic substrate materials. In each case an aggregate-free pattern of cutting lines and/or drilling areas is left in the substrate working surface, along which the weather resistant anti-slip panel can be cut or drilled on site.

Whilst the invention has been described with reference to simply-shaped sheet substrates, it is equally applicable to stair treads with preformed nosing or other particularly shaped GRP or plastics substrates or mouldings.

What is claimed is:

1. A shapeable, weather resistant anti-slip panel, comprising a cut resistant anti-slip coating on a working surface of an inflexible substrate and a pattern of uncoated, cuffing lines on the substrate; whereby, in use, the substrate can be cut along selected uncoated cutting lines to obtain a desired panel shape;

wherein the substrate is an unsaturated polyester based on an orthophthalic resin filled with e-glass fibre and has a Shore D hardness of between 80 and 100.

2. A panel as claimed in claim 1, wherein the substrate has the cut resistant, anti-slip coating solely on the working surface of the substrate.

3. A panel as claimed in claim 1, wherein the uncoated, cutting lines intersect to form a pattern of uncoated, drilling areas on the substrate; whereby, in use, the substrate can be drilled at selected uncoated, drilling areas to obtain a desired placement of fixing holes.

4. A panel as claimed in claim 3, comprising said anti-slip uncoated, cutting lines and uncoated, drilling areas on the working surface.

5. A panel as claimed in claim 1, wherein the anti-slip coating comprises anti-slip particles in an adherent coating.

6. A panel as claimed in claim 5, wherein the working surface has a pattern of anti-slip particles embedded therein.

7. A panel as claimed in claim 6, wherein the pattern of anti-slip particles comprises particle free lines or areas of coated substrate.

8. A panel as claimed in claim 1, wherein the cut resistant anti-slip coating includes an angular and cubic aluminum oxide particulate with a Polished Stone Value of between 50 to 100 and a mohs hardness of between 9 and 10.

9. A shapeable, weather resistant anti-slip panel, comprising a cut resistant anti-slip coating on a working surface of an inflexible substrate and a pattern of uncoated, cutting lines on the substrate; whereby, in use, the substrate can be cut along selected uncoated cutting lines to obtain a desired panel shape;

wherein the substrate is an unsaturated polyester based on an orthophthalic resin filled with e-glass fibre and has a maximum deflection of 25° when 1 kg is suspended from a fixed panel test piece 100 mm long×20 mm wide×3–3.5 mm thick.

10. A panel as claimed in claim 9, wherein the cut resistant, anti-slip coating is solely on the working surface of the substrate.

11. An anti-slip panel, comprising:

a substrate having a working surface and being made of a first material having a first hardness; and a cut-resistant anti-slip coating on the working surface of said substrate, said coating being made of a second material having a second hardness greater than the first hardness, said coating defining a pattern of uncoated, cutting lines on the working surface of said substrate;

wherein said working surface of said substrate is devoid of said second material along said cutting lines;

at least one of said cutting lines extending continuously from one edge to another edge of the substrate, thereby allowing said substrate to be cut along said at least one cutting line without cutting the cut-resistant anti-slip coating;

the first material is a unsaturated polyester based on an orthophthalic resin filled with e-glass fiber.

12. An anti-slip panel, comprising:

a substrate having a working surface and being made of a first material having a first hardness; and a cut-resistant anti-slip coating on the working surface of said substrate, said coating being made of a second material having a second hardness greater than the first hardness, said coating defining a pattern of uncoated, cutting lines on the working surface of said substrate;

wherein said working surface of said substrate is devoid of said second material along said cutting lines;

at least one of said cutting lines extending continuously from one edge to another edge of the substrate, thereby allowing said substrate to be cut along said at least one cutting line without cutting the cut-resistant anti-slip coating;

said panel further comprises a base resin disposed between the working surface of said substrate and said coating, said base resin bonding the second material of said coating to the working surface of said substrate; and the base resin is a unsaturated polyester based on an orthophthalic resin.

13. An anti-slip panel, comprising:

a substrate having a working surface and being made of a first material having a first hardness; and a cut-resistant anti-slip coating on the working surface of said substrate, said coating being made of a second material having a second hardness greater than the first hardness, said coating defining a pattern of uncoated, cutting lines on the working surface of said substrate;

wherein said working surface of said substrate is devoid of said second material along said cutting lines;

at least one of said cutting lines extending continuously from one edge to another edge of the substrate, thereby allowing said substrate to be cut along said at least one cutting line without cutting the cut-resistant anti-slip coating; and said coating is made of a plurality of particles of said second material, said particles being embedded in the first material of said substrate.

14. An anti-slip panel, comprising:

a substrate having a working surface and being made of a first material having a first hardness; and a cut-resistant anti-slip coating on the working surface of said substrate, said coating being made of a second material having a second hardness greater than the first hardness, said coating defining a pattern of uncoated, cutting lines on the working surface of said substrate;

wherein said working surface of said substrate is devoid of said second material along said cutting lines;

at least one of said cutting lines extending continuously from one edge to another edge of the substrate, thereby allowing said substrate to be cut along said at least one cutting line without cutting the cut-resistant anti-slip coating;

said second material has a mohs hardness of between 9 and 10.

* * * * *